United States Patent [19]

Ito et al.

[11] 4,320,674

[45] Mar. 23, 1982

[54] SCREW FASTENING APPARATUS

[75] Inventors: Genji Ito, Funabashi; Mitsunobu Tsunoo, Narashino; Fumio Fukuchi, Funabashi, all of Japan

[73] Assignee: Hitachi, Ltd., Tokyo, Japan

[21] Appl. No.: 158,391

[22] Filed: Jun. 11, 1980

[30] Foreign Application Priority Data

Jun. 20, 1979 [JP] Japan ..... 54/76754

[51] Int. Cl.[3] ..... B25B 13/00

[52] U.S. Cl. ..... 81/54; 81/57.42; 81/125

[58] Field of Search ..... 81/54, 57.42, 125; 279/16, 1 L

[56] References Cited

U.S. PATENT DOCUMENTS 3,368,431 2/1968 Kulaga ..... 81/54

3,731,722 5/1973 Carr ..... 81/125

3,967,664 7/1976 Lesner et al. ..... 81/54

4,098,001 7/1978 Watson ..... 33/189

FOREIGN PATENT DOCUMENTS 695768 11/1979 U.S.S.R. ..... 279/1 L

*Primary Examiner*—James L. Jones, Jr.

*Attorney, Agent, or Firm*—Craig and Antonelli

[57] ABSTRACT

Screw-holding device for receiving a screw are supported from three directions around the device and incline, whenever necessary. The screw-holding devices move in parallel at times. There are also provided engaging devices that are combined with the screw-holding devices and transmit a rotational torque to the screw-holding devices. A space is secured between these two devices for allowing the inclination of the screw-holding device.

5 Claims, 9 Drawing Figures

SCREW FASTENING APPARATUS

BACKGROUND OF THE INVENTION

This invention relates to an apparatus for fastening a male screw such as a bolt or a female screw such as a nut to a mating female or male screw.

To fasten two mating screws together, it is necessary to first align accurately the center lines of the two screws and then to rotate one of the screws. The human hand is so skilful that it is capable of carrying out smoothly the screw fastening work. However the screw fastening work can not be said to be really suited for the human hand. On the assembly line of a given product, the screw fastening works of the same work pattern are sequentially repeated one after another. Sometimes large screws are employed. It is desired in such a condition to automatically execute the screw fastening work without relying upon the manual work.

It is actually difficult, however, to accurately align the center lines of two mating screws with each other without the manual work. One of preferred methods is to automatically correct non-alignment of the two center lines by the aid of a resilient mechanism even when both screws are not brought into accurate alignment with each other. Understandably, U.S. Pat. No. 4,098,001 is based upon this concept. The invention disclosed in this prior art employs such an arrangement that a rotational torque required for the screw fastening work is transmitted via bellows.

When large-sized screws are to be fastened, a stronger rotational torque is required for fastening them. Hence, it is a critical problem how to transmit the stronger rotational torque without sacrificing the function of the resilient mechanism.

SUMMARY OF THE INVENTION

It is an object of the present invention to make it possible to execute automatically the screw fastening work without manual work.

It is another object of the present invention to impart a necessary strong rotational torque to a screw to be fastened.

It is another object of the present invention to impart a necessary rotational torque to a screw to be fastened, although the screw inclines, whenever necessary.

It is still another object of the present invention to make it possible for the screw to be fastened to move in the direction crossing its center line at a right angle, whenever necessary.

It is still another object of the present invention to impart a necessary strong rotational torque to the screw to be fastened, although the screw inclines or moves, whenever necessary.

It is still another object of the present invention to prevent a mechanism for inclining the screw from being applied with an excessive force resulting from the rotational torque.

It is a further object of the present invention to effectively obtain a force for inclining or moving the screw to be fastened from a spring.

It is a further object of the present invention to automatically detect completion of the screw fastening work so as to smoothly proceed to the subsequent work.

These and other objects of the invention will become more appararent from the following detailed description thereof.

In the present invention, there are employed screw-holding means for restricting the screw to be fastened. The screw-holding means are tiltably supported by three fingers so as to correct the inclination thereof, whenever necessary, and to ensure smooth fastening of the screw to be fastened, which is restricted by the screw-holding means, to a mating screw. These three fingers function as a kind of resilient mechanism.

The screw-holding means are combined with engaging means. The engaging means are employed for compulsively rotating the screw-holding means. The screw-holding means and the engaging means are spline-coupled to each other so that a strong rotational torque acts upon the screw-holding means. For realizing the spline-coupling, the center lines of both means are substantially aligned with each other. The mode of spline-coupling between both means is rather specific and a predetermined space exists between them. This space allows the inclination of the screw-holding means. In the present invention, the rotational torque of rotation driving means is transmitted to the engaging means via power transmission means.

In the arrangement as described above, it becomes possible to incline the screw-holding means, whenever necessary, and to rotate the same. However, there is a case where mere inclination or rotation of the screw-holding means is not sufficient. This is when the screw-holding means must be moved in the direction crossing the center line at a right angle thereto. A slide member is used to satisfy this requirement. The slide member is furnished with finger-holding means that support the aforementioned three fingers. When the slide member slides, therefore, the screw-holding means also slide together with the three fingers. Thus, the screw-holding means are allowed both to incline and to move in parallel. Whenever necessary, the screw-holding means move in such a manner as to incline their center line. It is also possible for the screw-holding means to move in such a manner as not to change the direction of the center line.

One of the critical problems here is that when the screw-holding means move in the direction crossing the center line thereof at a right angle, the relative positions between the screw-holding means and the engaging means change. Such a change is not desirable for making effective use of the space provided between both means for the inclination of the screw-holding means. Accordingly, both of finger-holding means and engaging means are provided on the slide member so that even when the slide member slides, the relative positions between the screw-holding means and the engaging means remain unaltered. According to this arrangement, it becomes possible to set the size of the space provided between the screw-holding means and the engaging means to a rather small size. This also provides the advantage in that an excessive force resulting from the rotational torque is prevented from acting upon the three fingers that support the screw-holding means.

The force required for inclining or moving in parallel the screw-holding means is given as a component of the force that pushes the screw held in the screw-holding means to the mating screw. If the force for pushing the screw to the mating screw is too strong, both screws would be damaged. If it is too weak, on the contrary, it becomes impossible to incline or move in parallel the screw-holding means. In order to obtain a suitable force, a predetermined spring is employed. This spring is compressed when both screws meet one another and so functions as to push the screw-holding means, the engaging means and other structural elements. As screw fastening proceeds, the screw-holding means are pushed out in a distance corresponding to the pitch of the screw. This can be detected by a proximate switch or the like.

EXPLANATION OF REFERENCE NUMERALS

Figure 1:
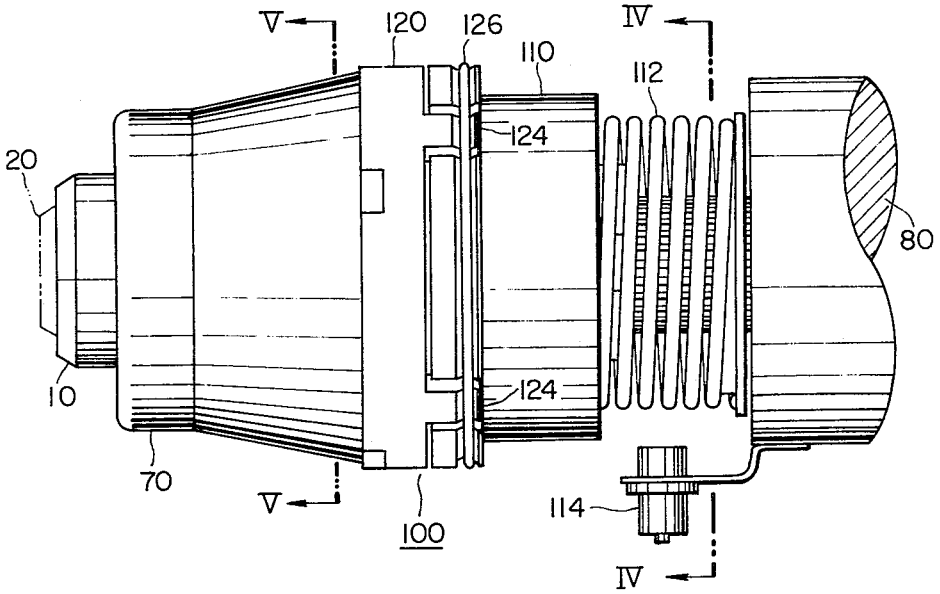
FIG. 1 is a front view showing an embodiment of the apparatus of the present invention.

10: screw-holding means
- 12: magnet
- 14: protuberance
- 16: center line
- 18: spring

20: screw
30: finger
40: first pin
50: finger-holding means
60: second pin
70: engaging means
- 72: space
- 74: groove
- 76: center line

80: rotation driving means
90: support shaft
100: power transmission means
110: boss
- 112: spring
- 114: proximate switch

120: slide member
- 122: steel ball
- 124: horn
- 126: ring

130: connection means
- 132: bolt
- 134: slide washer
- 136: hole $l_1$: radius
$l_2$: raidus
$l_3$: imaginary cone
P: apex

DESCRIPTION OF THE PREFERRED EMBODIMENT

Hereinafter, an embodiment of the present invention will be explained with reference to the accompanying drawings.

In the drawings, reference numeral 10 designates screw-holding means. The means are employed for restricting a screw 20 as an object to be fastened. The screw 20 is represented by two-dot chain line in some drawings. The screw 20 is a nut which is accommodated in the screw-holding means 10 so that a part of the nut is exposed. Reference numeral 12 designates a magnet which is disposed inside the screw-holding means 10 and functions to attract the screw 20 thereto and to prevent the screw from falling down. Three protuberances 14 are defined around the outer circumference of the screw-holding means 10 in such a manner as to protrude partially. These are used for spline coupling. Reference numeral 16 represents the center line of the screw-holding means 10.

Figure 5:
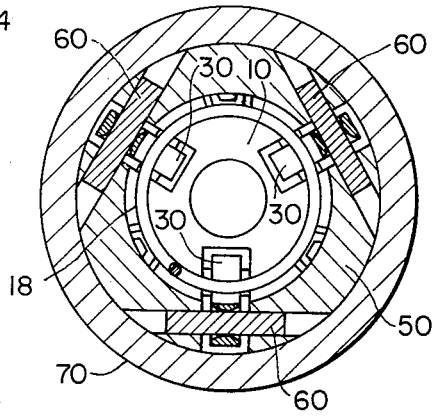
FIG. 5 is a sectional view taken along line V—V of FIG. 1.

Reference numeral 30 represents three fingers in all. These fingers support the screw-holding means 10 from the three directions around the means. Arrangement of each finger 30 is best shown in FIG. 5. Each finger 30 is made of a metal. The screw-holding means 10 and the three fingers 30 are coupled by means of three first pins 40 in all. Reference numeral 50 designates finger-holding means. The finger-holding means 50 and the three fingers 30 are coupled by three second pins 60 in all. Coupling by means of each first pin 40 and of each second pin 60 is relatively mild with the consequence that each finger 30 is permitted to tilt relative to the finger-holding means 50 and the screw-holding means 10 are also permitted to tilt relative to each finger 30. Though each finger 30 itself is made of a metal, the screw-holding means 10 supported by these fingers are capable of changing the posture relatively freely.

Figure 6:
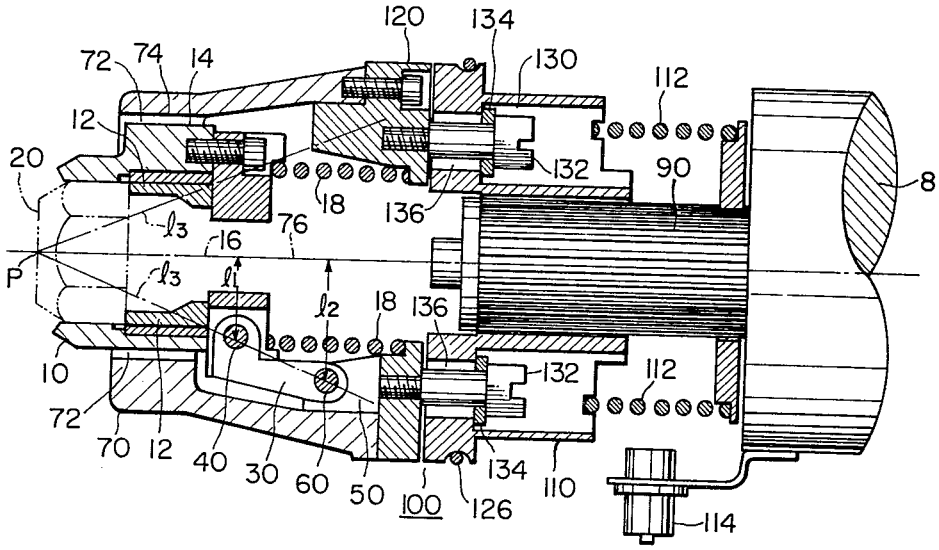
FIG. 6 is a longitudinal sectional view of FIG. 1.

In FIG. 6, $l_1$ represents the radius of an imaginary circle around the pivotal point of each of the first pins 40, and $l_2$ represents the radius of an imaginary circle around the pivotal point of each of the second pins 60. The radius $l_2$ is greater than the radius $l_1$. $l_3$ represents an imaginary cone that encompasses the circumference of the radius $l_1$ and that of the radius $l_2$. Symbol P corresponds to its apex. This apex P serves as a guide of the center when the screw-holding means 10 tilt as a whole. Strictly speaking, however, motion of the screw-holding means 10 is so complicated that its center cannot be determined, but in the sense of approximation, the apex P might be regarded as the center of the motion. As can be appreciated from FIG. 6, the apex P of the imaginary cone $l_3$ is located at the tip of the screw 20, thereby making it easy to face the screw 20 with a mating screw.

Figure 7:
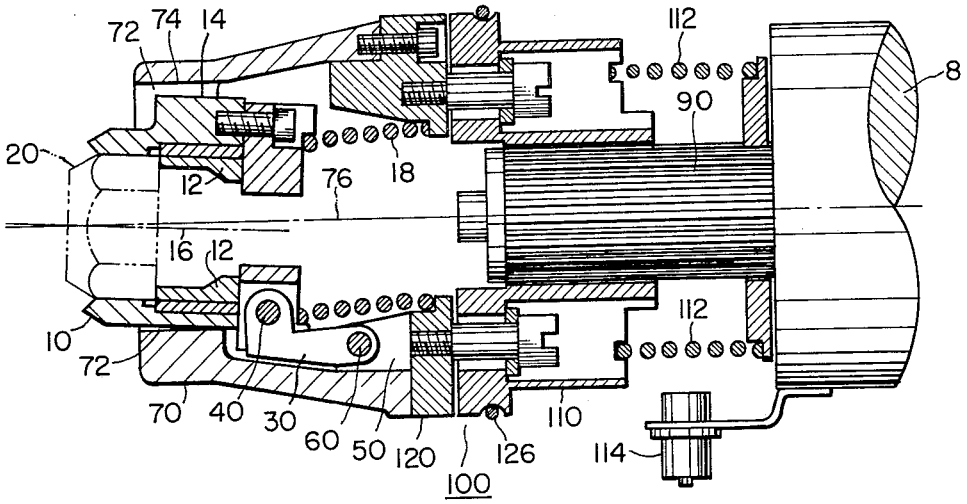
FIG. 7 is a longitudinal sectional view which corresponds to FIG. 6 and shows the state where the screw holding means incline.

Reference numeral 70 designates engaging means. The engaging means 70 are brought into spline coupling with the screw-holding means 10 with a predetermined space 72 between them. Reference numeral 74 designates three grooves that are formed on the engaging means 70. Each groove 74 is combined with each protuberance 14 of the screw-holding means 10 with the space 72 between them. This coupling is gentle spline coupling. The center line 76 of the engaging means 70 is brought into substantial conformity with that 16 of the screw-holding means 10. Though these means are shown out of perfect alignment with each other in FIG. 7, variance is not much great. In any case, the rotational torque of the engaging means 70 is effectively transmitted to the screw-holding means 10 spline-coupled to the former. The space 72 is to permit the inclination of the screw-holding means 10.

Reference numeral 80 designates rotation driving means. Though not shown, the means are disposed on the wrist of a robot, for example. Reference numeral 90 designates a support shaft that serves as the output shaft of the rotation driving means 80. This support shaft 90 also functions as a center axis of rotation for the finger-holding means 50 as well as for the engaging means 70. The rotational torque of the rotation driving means 80 is transmitted to the engaging means 70. Power transmission means for this purpose is represented by reference numeral 100. As will be explained later, the means 100 consist of several structural elements. Reference numeral 110 designates bosses that are arranged around the support shaft 90. The support shaft 90 and the boss 110 are spline-coupled in the most oridnary manner.

Each drawing is drawn in the standard state where the boss 110 is fully moved towards the tip of the support shaft 90. Reference numeral 112 designates a spring that urges the boss 110 in the direction of the screw-holding means 10. This spring 112 plays the role of pushing the screw 20 to the mating screw with a predetermined pressure. It also plays the role of permitting the advance of the screw 20 along its rotation. Reference numeral 114 designates a proximate switch for detecting the position of the boss 110. The proximate switch 114 is fixed to the rotation driving means 80. If the position of this switch 114 is accurately located in advance, however, it becomes possible to determine whether or not fastening of the screw 20 is completed, by detecting the presence of the boss 112 in the proximity of the switch.

Figure 3:
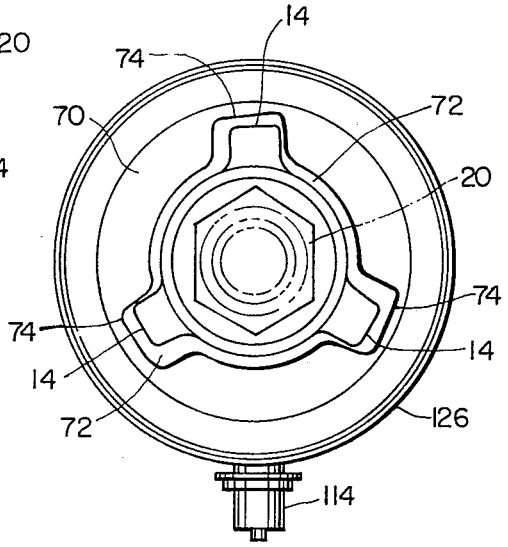
FIG. 3 is a left-hand side view which corresponds to FIG. 2 and shows the state when the phase of rotation of the engaging means changes.
Figure 4:
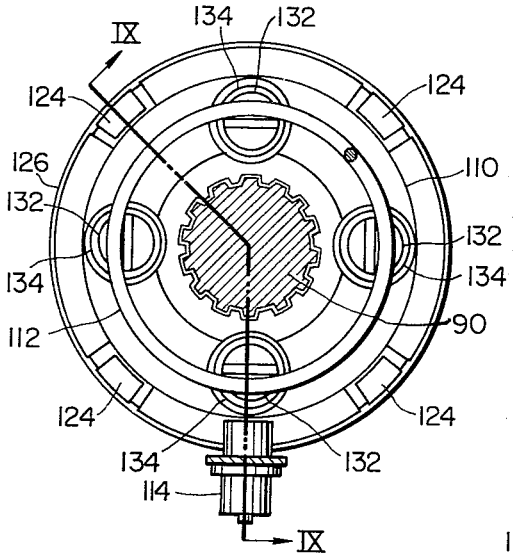
FIG. 4 is a sectional view taken along line IV—IV of FIG. 1.
Figure 9:
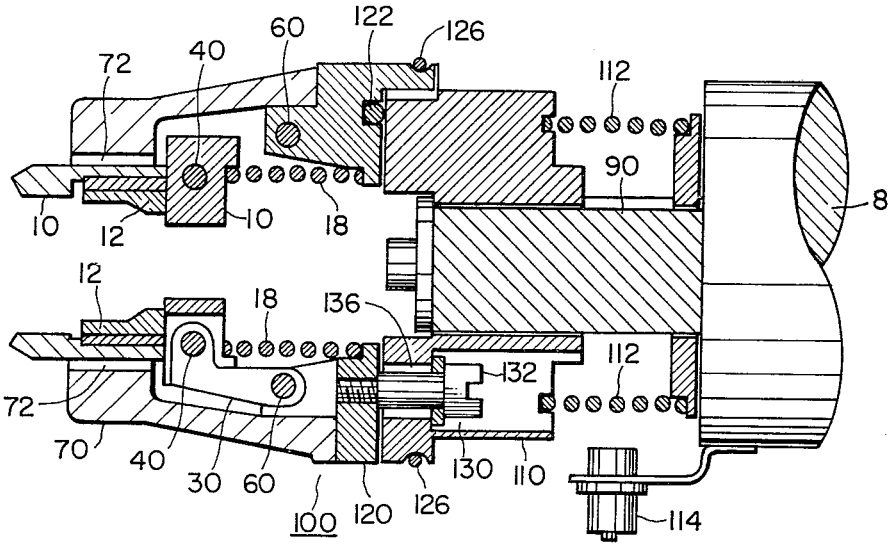
FIG. 9 is a sectional view taken along line IX—IX of FIG. 4.

Reference numeral 120 represents a slide member. The basic role of this slide member 120 is to allow the screw-holding means 10 to move in the direction crossing its center line 16 at a right angle. The slide member 120 is combined with the boss 110 in such a manner as to be capable of moving along the edge surface of the boss 110. The sliding direction of the slide member 120 crosses the support shaft 90 at a right angle thereto. Reference numeral 122 designates a number of steel balls that are interposed between the slide member 120 and the boss 110. However, only one steel ball 122 is shown disposed in the drawing. The steel balls 122 are employed for making smooth the sliding movement of the slide member 120. Reference numeral 130 designates four connecting means for connecting the slide member 120 to the boss 110. Each means consists of a bolt 132 screwed into the slide member 120, a slide washer 134 combined with the bolt 132 and a hole 136 bored on the boss 110. Though inserted into the hole 136, the bolt 132 is capable of moving within a predetermined range because the diameter of the hole 136 is set relatively largely. The connecting means 130 also function to restrict the sliding direction of the slide member 120 as described previously. As can be best seen in FIGS. 1, 3 and 9, four horns 124 are formed on the outer circumferential portion of the slide member 120. The horns 124 are combined gently with four recesses formed on the boss 110, respectively. Reference numeral 126 designates highly resilient rings that are arranged in such a manner as to encompass the abovementioned combined portions. When the slide member 120 slides, this ring 126 undergoes deformation and thereby functions to push back the slide member 120 to its original position.

The finger-holding means 50 are disposed on the slide member 120. The engaging means 70, too, are disposed on the slide member 120. For these reasons, even when the slide member 120 slides, there occurs no change at all in the relative position between the screw-holding means 10 and the engaging means 70. Reference numeral 18 designates a spring interposed between the slide member 120 and the screw-holding means 10. This spring 18 prevents the undesirable movement of the screw-holding means 10 due to its own weight and to the weight of the screw 20 and sets the means to a posture which is to be a standard. The aforementioned power transmission means 100 comprise the support shaft 90, the boss 110, the connecting means 130 and the slider member 120.

As the construction of the embodiment has thus been described, the mode of use and the state of operation of the apparatus of the present invention will now be explained. First, the screw 20 is fitted to the screw-holding means 10. The screw 20 is placed at a predetermined position and the rotation driving means 80 disposed at the wrist of the robot are actuated so that the screw-holding means 10 are moved to the position of the screw 20, thereby completing fitting of the screw 20. Next, the robot is actuated so as to push the screw 20, which is kept inside the screw-holding means 10, onto the mating screw. Though not shown in the drawing, the mating screw belongs to a semi-finished product on the assembly line. At this stage the spring 112 is compressed and the boss 110 moves backward. Along therewith, the presence of the boss 110 is detected by the proximate switch 114, thereby making it possible to identify at which step the apparatus is positioned as a whole.

It does not necessarily happen that the screw 20 is in accurate alignment with the mating screw, because there is the problem of the accuracy for each screw. If the center line of the screw 20, or the center line 16 of the screw-holding means 10, is inclined relative to the center line of the mating screw, force for correcting the inclination is applied to the screw 20. This force corresponds to a component of the pushing force of the spring 112. As a result, the center line 16 is inclined by a necessary angle as can be appreciated from FIG. 7. The spring 18 does not have such a force as to prevent the inclination. The screw-holding means 10 incline without being hindered by the engaging means 70 because the space 72 is secured between these means.

Figure 8:
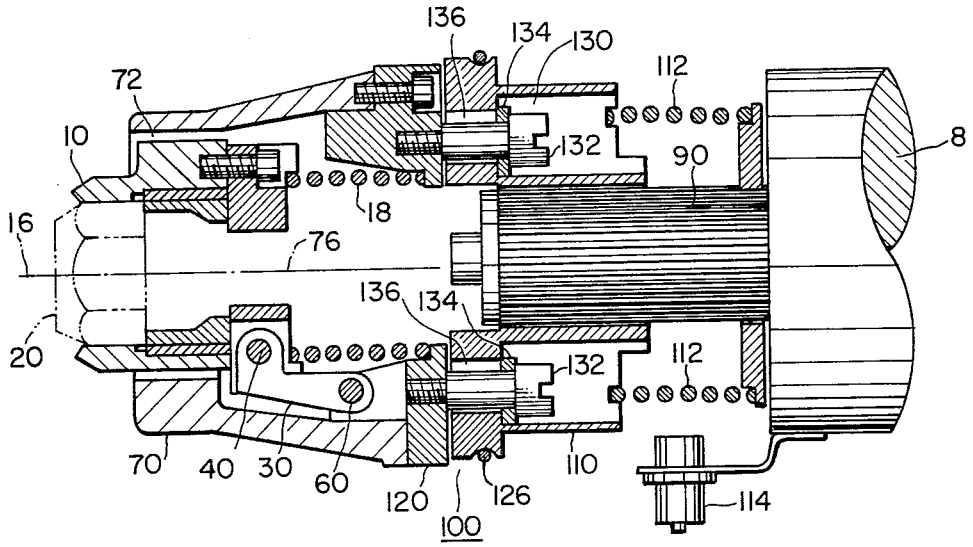
FIG. 8 is a longitudinal sectional view which corresponds to FIG. 6 and shows the state when the slide member slides.

In case it is necessary to move the center line 16 of the screw-holding means 10 in parallel, the slide member 120 is to move relative to the boss 110. FIG. 8 shows the state after such movement. Under this state each bolt 132 is placed at a position away from the center of each hole 136. The ring 126 prevents the slide member 120 from sliding in an undesirable manner owing to the gravity. When a force stronger than the gravity acts on the slide member 120, however, the ring itself undergoes slight deformation and allows the slide member 120 to slide eventually. When the slide member 120 slides, both of finger-holding means 50 and engaging means 70 disposed on the slide member 120 also move in the interlocking arrangement. For this reason, the relative position between the finger-holding means 10 and the engaging means 70 remains perfectly unchanged.

If there is an excessive error in the relative position between the screw 20 and its mating screw, there occurs no force that causes the slide member 120 to slide in the desired direction, how much strongly the screw 20 may be pushed to the mating screw. If such a state is expected, it is preferred that either one, or both, of the screw 20 and the mating screw be furnished with a predetermined tapered surface.

It is rarely happens that only inclination of the screw-holding means 10 is necessary or only sliding of the slide member 120 is necessary. In practice, both are simultaneously necessary. As pointed out already, the relative position between the finger-holding means 10 and the engaging means 70 does not change at all even if the slide member 120 slides. For this reason, it is possible to make effective use of the space 72 between these means for the inclination of the screw-holding means 10. There is no danger at all, either, that sliding of the sliding member 120 is hindered due to the inclination of the screw-holding means 10.

Figure 2:
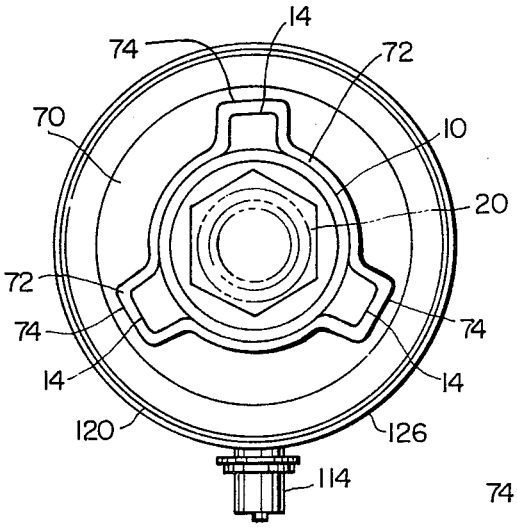
FIG. 2 is a left-hand side view of the apparatus shown in FIG. 1.

After the center line of the screw 20 is brought into precise conformity with that of the mating screw, the rotation driving means 80 are actuated whereby the rotational torque is transmitted to the engaging means 70 via the power transmission means 100 and the engaging means 70 start rotating. Namely, the state changes from the one shown in FIG. 2 to the one shown in FIG. 3. Under the state shown in FIG. 3, the phase of rotation of the engaging means 70 with respect to the screw-holding means 10 advances slightly and each protuberance 14 comes into contact with each groove 74 of the engaging means 70. Hence, both rotate with each other. Advance of the phase of rotation of the engaging means 70 with respect to the screw-holding means 10 depends upon the size of the space 72. When the phase of rotation changes, each finger 30 is caused to incline in the helical form. In order not to apply an excessive force to each finger 30, each first pin 40 and each second pin 60, therefore, the space 72 must not be greater than necessary. When the screw-holding means 10 deviates from the engaging means 70, on the other hand, the allowance for inclination of the screw-holding means 10 becomes disadvantageously small in comparison with the size of the space 72 provided for that purpose. Accordingly, it is desired that not only the screw-holding means 10 but also the engaging means 70 be constructed in the interlocking arrangement with the slide member 120.

As the screw 20 is rotated together with the screw-holding means 10 and fastening of the screw thus proceeds, the boss 110 advances in a distance corresponding to the pitch. This arises from the force of the spring 112. It is not necessary to advance the rotation driving means 80 connected to the robot. When fastening of the screw 20 is completed, the boss 110 moved away from the proximate switch 114, thus making it possible to confirm the completion. The work shifts to the next step, repeating thereby the sequence of the abovementioned operations.

The timing for actuating the rotation driving means 80 may be at the stage prior to the accurate alignment of the center line of the screw 20 with that of the mating screw. In such a case, under the state shown in FIG. 3, the screw-holding means 10 incline or the slide member 120 slides. This is possible in practice. Under the state shown in FIG. 3, the screw-holding means 10 and the engaging means 70 are coupled to one another at three positions and this mode of coupling does not hinder the inclination of the screw-holding means 10 by utilizing the space 72.

What is claimed is:

1. A screw fastening apparatus comprising:

screw-holding means for restricting a screw;

three fingers in all for supporting said screw-holding means from three directions therearound in such a manner as to allow the inclination of said screw-holding means;

finger-holding means for supporting each of said fingers;

engaging means having the center line substantially brought into conformity with that of said screw-holding means and spline-coupled to said screw-holding means with a space required for the inclination of said screw-holding means between them;

a support shaft functioning as the center axis of rotation for both of said finger holding means and said engaging means;

rotation driving means using said support shaft as the output shaft thereof; and power transmission means for transmitting the rotational torque of said rotation driving means to said engaging means.

2. The screw fastening apparatus as defined in claim 1, further including:

a slide member equipped with said finger holding means;

a boss combined with said support shaft as the output shaft of said rotation driving means; and connection means for connecting said slide member to said boss and restricting the sliding direction of said slide member in the direction crossing perpendicularly said support shaft.

3. The screw fastening apparatus as defined in claim 2, which further includes said slide member equipped with said finger-holding means and said engaging means.

4. The screw fastening apparatus as defined in claim 2, which further includes a spring for urging said boss, combined with said support shaft, towards said screw-holding means in the longitudinal direction of said support shaft.

5. The screw fastening apparatus as defined in claim 4, which further includes means for detecting the position of said boss moving in the longitudinal direction of said support shaft.

* * * * *